US011452324B2

(12) United States Patent
Inzer

(10) Patent No.: US 11,452,324 B2
(45) **Date of Patent: *Sep. 27, 2022**

(54) ADJUSTABLE SLEEVE SUPPORT SHIRT

(71) Applicant: John Inzer, Longview, TX (US)

(72) Inventor: John Inzer, Longview, TX (US)

(73) Assignee: INZER ADVANCE DESIGNS, INC., Longview, TX (US)

( * ) Notice: Subject to any disclaimer, the term of this patent is extended or adjusted under 35 U.S.C. 154(b) by 155 days.

This patent is subject to a terminal disclaimer.

(21) Appl. No.: 16/939,521

(22) Filed: Jul. 27, 2020

(65) Prior Publication Data

US 2020/0352260 A1 Nov. 12, 2020

Related U.S. Application Data

(63) Continuation of application No. 14/809,421, filed on Jul. 27, 2015, now Pat. No. 10,757,986.

(51) Int. Cl.
*A41D 31/18* (2019.01)
*A41D 13/00* (2006.01)

(52) U.S. Cl.
CPC ..... *A41D 31/18* (2019.02); *A41D 13/0015* (2013.01); *A41D 31/185* (2019.02); *A41D 2300/32* (2013.01); *A41D 2300/322* (2013.01); *A41D 2300/324* (2013.01)

(58) Field of Classification Search
CPC .. A41D 31/18; A41D 13/0015; A41D 31/185; A41D 2300/32; A41D 2300/322; A41D 2300/324
See application file for complete search history.

(56) References Cited

U.S. PATENT DOCUMENTS

| | | | | |
|---|---|---|---|---|
| 2,035,377 | A | 3/1936 | Redmond | |
| 2,164,036 | A | 6/1939 | Lane | |
| 2,280,025 | A * | 4/1942 | Bollinger | A61F 13/085 602/60 |
| 2,309,601 | A | 1/1943 | Kneibler | |
| 2,741,203 | A | 4/1956 | Rand | |
| 2,959,837 | A | 11/1960 | Jette | |
| 4,473,908 | A | 10/1984 | Knecht | |
| 4,586,272 | A * | 5/1986 | Forster | A41D 17/00 36/2 A |
| 5,046,194 | A | 9/1991 | Alaniz et al. | |
| 5,383,235 | A | 1/1995 | Peters | |
| 5,564,123 | A * | 10/1996 | Grassick | A41D 13/1245 2/114 |
| 5,822,794 | A | 10/1998 | Allred | |
| 5,829,058 | A | 11/1998 | Dicker et al. | |
| 5,937,442 | A | 8/1999 | Yamaguchi et al. | |
| 5,957,878 | A | 9/1999 | Gilliam | |
| 6,021,524 | A | 2/2000 | Wu et al. | |

(Continued)

*Primary Examiner* — Khaled Annis
(74) *Attorney, Agent, or Firm* — Dinsmore & Shohl LLC

(57) ABSTRACT

An adjustable support shirt comprising a shirt body and a pair of shirt body sleeves positioned adjacent to an upper portion of the shirt body is provided. The sleeves include a first end attached to the shirt body at sleeve body holes and a second end having a sleeve opening circumference. Each of the sleeves includes at least one adjustable member which extends generally longitudinally along at least a portion of the sleeves. The at least one adjustable member is adapted to increase or decrease the sleeve opening circumference.

20 Claims, 12 Drawing Sheets

(56) References Cited

U.S. PATENT DOCUMENTS

| | | | | |
|---|---|---|---|---|
| 6,446,264 | B2 | 9/2002 | Fairhurst et al. | |
| 6,675,389 | B1 * | 1/2004 | Kublick | B63C 11/04 2/128 |
| 6,892,396 | B2 | 5/2005 | Uno et al. | |
| D608,077 | S * | 1/2010 | Bybee | D2/717 |
| 7,941,871 | B1 | 5/2011 | Jorgensen | |
| 8,533,864 | B1 | 9/2013 | Kostrzewski | |
| 8,578,517 | B2 | 11/2013 | Alaniz et al. | |
| 8,910,317 | B2 | 12/2014 | Decker | |
| 2004/0016041 | A1 | 1/2004 | Uno et al. | |
| 2006/0085889 | A1 | 4/2006 | Okajima | |
| 2006/0230490 | A1 * | 10/2006 | Okajima | A41D 13/0015 2/77 |
| 2006/0277653 | A1 * | 12/2006 | Okajima | A41D 27/10 2/93 |
| 2007/0000015 | A1 | 1/2007 | Alaniz et al. | |
| 2008/0196136 | A1 | 8/2008 | Fellouhe et al. | |
| 2009/0056870 | A1 | 3/2009 | Glenn | |
| 2009/0113596 | A1 | 5/2009 | Young | |
| 2009/0139005 | A1 | 6/2009 | Whaley | |
| 2010/0043115 | A1 | 2/2010 | Weatherill et al. | |
| 2010/0064415 | A1 | 3/2010 | Melhart et al. | |
| 2010/0077527 | A1 | 4/2010 | Lee et al. | |
| 2010/0218300 | A1 | 9/2010 | Aaniz et al. | |
| 2011/0083246 | A1 | 4/2011 | Vitarana | |
| 2011/0302686 | A1 | 12/2011 | Chapuis | |
| 2012/0304359 | A1 * | 12/2012 | Bybee | A41D 13/0015 2/79 |
| 2013/0067628 | A1 | 3/2013 | Harb | |
| 2013/0160189 | A1 | 6/2013 | Yang | |
| 2013/0167285 | A1 | 7/2013 | Decker | |
| 2013/0237110 | A1 | 9/2013 | Morales | |
| 2013/0298302 | A1 | 11/2013 | Whaley | |
| 2013/0326785 | A1 | 12/2013 | Cornacchiari et al. | |
| 2014/0317826 | A1 | 10/2014 | Decker | |
| 2014/0325732 | A1 | 11/2014 | Anderson | |
| 2015/0189926 | A1 | 7/2015 | Bunting | |
| 2015/0189927 | A1 | 7/2015 | Bunting | |
| 2016/0262474 | A1 | 9/2016 | Inzer | |
| 2017/0232290 | A1 | 8/2017 | Alaniz, III | |

* cited by examiner

ADJUSTABLE SLEEVE SUPPORT SHIRT

CROSS-REFERENCE TO RELATED APPLICATION

This application is a continuation application of co-pending U.S. patent application Ser. No. 14/809,421, filed Jul. 27, 2015, for "Adjustable Sleeve Support Shirt," which is hereby incorporated by reference in its entirety including the drawings.

BACKGROUND

The subject matter described herein relates to a shirt or garment which covers the torso of a wearer. Specifically, embodiments are directed to a support shirt providing support along the chest and shoulder regions of a wearer. The support shirt can be used for a variety of sporting or work activities where support of the chest and shoulders is desired. One such application is a bench press shirt for support in weightlifting activities. Other applications include jobs involving lifting, pushing, or pulling heavy objects.

Bench press shirts provide an increase in the amount of weight a bench presser can lift as well as increased safety to the bench presser. Typically, bench press shirts are made of taut, relatively inelastic materials having high tensile strength, such as double knit polyester, canvas or denim. As distinguished from "compression shirts" which are fabricated of elastic, stretchable fabrics, bench press shirts fit tightly over the wearer, but do not stretch. The tightness of bench press shirts in general, and the tautness and relative inelasticity of the fabric, makes it difficult and time consuming to don a bench press shirt as compared to a tight T-shirt or compression shirt. In some instances, bench press shirts require assistance from another person to pull, push and pinch the fabric of the shirt into position onto the torso and arms of the wearer. There is a trade-off between the need for tautness, a tight fit, and tensile strength in the shirt to increase support for lifting versus the increased difficulty of donning such a shirt.

While bench press shirts have been designed in the past to provide support for the wearer, such shirts have suffered from one or more deficiencies. For example, U.S. Pat. No. 5,383,235 describes a zippered shirt which may be made of stretchable material in which the circumference of the area across the upper torso is less than that of the waist and lower portion of the shirt. Other weightlifting shirt designs focus on the type of material and configuration of the fabrics used across the upper chest. Such designs employ fabric or material across the shirt which fails to reinforce the shoulder and chest of a wearer during the bench press exercise. A deficiency in all previous designs has been the problem of easing ingress and egress from the bench press shirt, while still providing the fabric with the tautness and tensile strength needed for support.

Therefore, a need exists for an adjustable support shirt which provides for easier ingress and egress, reducing the effort required to put on and take off the shirt, while still providing the necessary shoulder and chest support during weightlifting or other work-related lifting activities.

BRIEF SUMMARY

That need is addressed by embodiments of the present invention which provide an adjustable support shirt which provides for easier ingress and egress, reducing the effort required to put on and take off the shirt, while still providing the necessary shoulder and chest support during weightlifting or other work-related lifting activities.

In accordance with one embodiment of the present invention, an adjustable support shirt is provided which comprises a shirt body and a pair of shirt body sleeves positioned adjacent to an upper portion of the shirt body. The sleeves comprise a first end attached to the shirt body at sleeve body holes and a second end having a sleeve opening circumference. Each of the sleeves includes at least one adjustable member which extends generally longitudinally along at least a portion of the sleeves. The at least one adjustable member is adapted to increase or decrease the sleeve opening circumference, thereby permitting easier ingress and egress to the shirt, while still providing the necessary shoulder and chest support for sports or work-related lifting activities.

The at least one adjustable member may comprise any device or structure which is capable of enlarging and reducing the circumference of the sleeve opening. For example, the adjustable member may take the form of laces, a zipper, a hook and loop fastener, snaps, or buttons. In use, the wearer enlarges the sleeve openings by, for example, unzipping a zipper, loosening laces, or unbuttoning buttons, to allow the wearer to don the shirt with less effort. Once the shirt is on, the wearer can, for example, then close the zipper or tighten the laces, to provide a taut fitting shirt that provides support to the shoulders and chest for sports or work-related lifting activities.

For example, where laces are used as the adjustable member, the laces may be positioned so that they extend along at least some portion of the length of the sleeve. In some embodiments, the laces will extend from adjacent the sleeve opening to adjacent the shirt body hole. In some embodiments, the laces are positioned on an outward facing portion of the sleeve. However, the adjustable member, including laces, may be positioned at any location around the circumference of the sleeve.

In other embodiments, a zipper may be used as the adjustable member. In those embodiments, the zipper will extend along at least a portion of the length of the sleeve. In some embodiments, the zipper will extend from adjacent the sleeve opening to adjacent the shirt body hole. In some embodiments, the zipper is positioned on an upward facing portion of the sleeve. As with other embodiments, the adjustable member, including a zipper, may be positioned at any location around the circumference of the sleeve.

The adjustable shirt may be fabricated from a number of materials so long as those materials have sufficient tensile strength to withstand the stresses and strains encountered by a wearer engaging in lifting activities. In some embodiments, the shirt may be fabricated from a single or multiply fabric. The fabric may comprise cotton (e.g., canvas), polyester, nylon, or an elastic material such as, for example, Spandex® or Lycra®, or combinations thereof.

In some embodiments, the shirt sleeves may include a gusset extending beneath and generally coextensive with the at least one adjustable member. The gusset is formed so that it connects adjacent portions of the sleeve. In some embodiments, the gusset comprises an elastic material such as a natural or synthetic rubber such as neoprene rubber, or an elastic fabric material such as Spandex® or Lycra®, or combinations thereof.

In some embodiments, the adjustable shirt will include first and second adjustable members which extend along at least a portion of the length of the sleeves. For example, the first adjustable member may comprise a zipper and the second adjustable member may comprise laces. Alternatively, the first adjustable member may comprise buttons and the second adjustable member may comprise laces. In yet other embodiments, the first adjustable member may comprise a hook and loop fastener and the second adjustable member may comprise laces. In yet another embodiment, the first adjustable member may comprise snaps and the second adjustable member may comprise laces. Other combinations of adjustable members are possible and are within the scope of the present invention.

In embodiments where the adjustable shirt is in the form of a bench press shirt, the sleeves will extend forward of a frontal plane extending across the shirt body at an angle of from about 60° to about 180°. The sleeves will also extend from a transverse plane extending substantially perpendicular to the frontal plane at an angle of from about +45° to about −45°.

Accordingly, it is a feature of embodiments of the present invention to provide an adjustable support shirt which provides for easier ingress and egress, reducing the effort required to put on and take off the shirt, while still providing the necessary shoulder and chest support during weightlifting or other work-related lifting activities. Other features and advantages of the present invention will be apparent from the following detailed description, the accompanying drawings, and the appended claims.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
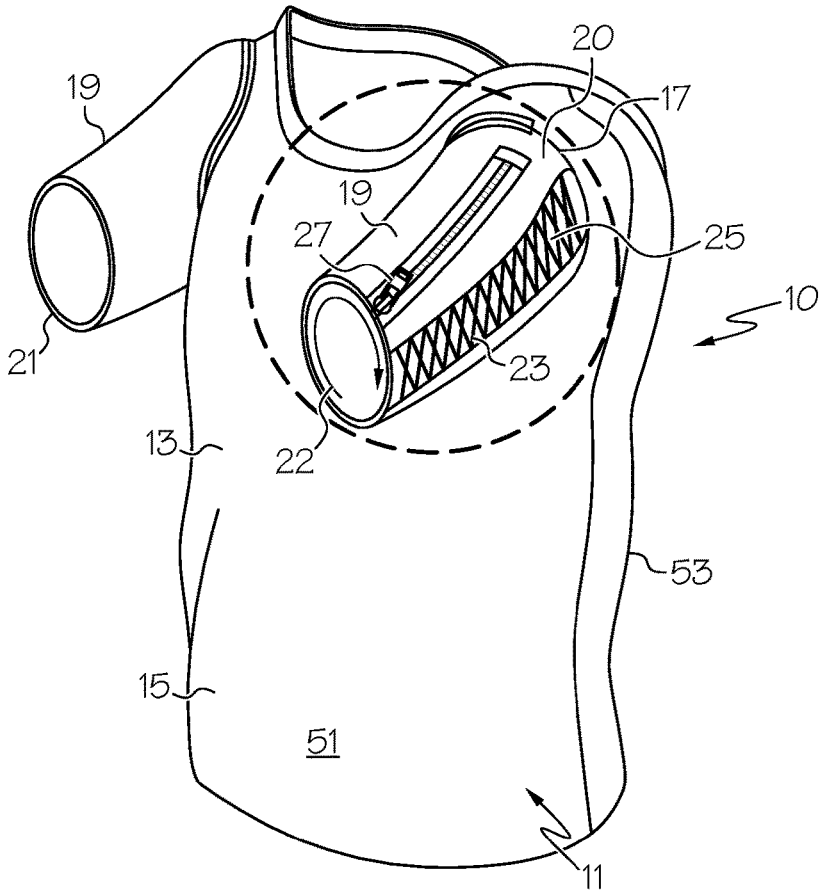
FIG. 1 depicts a perspective view of one embodiment of the adjustable support shirt of the present invention.

Referring initially to FIGS. 1-7B, in an exemplary embodiment of the invention, a support shirt 10 comprises a shirt body 11 worn across the torso of an individual. The shirt body 11 comprises an upper shirt body 13 and lower shirt body 15, as shown, for example, in FIG. 1. Additionally, the shirt body 11 has a shirt front 51 and shirt back 52 joined at a body seam 53. In an alternate embodiment (not shown), the shirt body by be fabricated from a unitary piece of fabric. The shirt body 11 is comprised of a supporting fabric extending across at least the upper shirt body 13. The support shirt is sized so that the supporting fabric is taut against the wearer's body when worn, providing support across the upper torso of the individual. The tautness of the fabric provides increased pressure exerted across the pectoralis major and serratus anterior muscles of the wearer.

The fabric may be comprised of stretchable or non-stretchable material. Additionally, the fabric may be single ply or multi-ply and may be comprised of: cotton (e.g., canvas) fabric; polyester; spandex type fabric; nylon fabric; or any kind of fabric that holds tautness. Further, the shirt body and sleeves may be comprised of polymeric material having a suitable thickness to provide the requisite strength. Shirt body sleeve holes 17 are positioned on the front of the shirt near the upper shirt body 13, corresponding with the area of traversal of the wearer's arms. The fabric comprising shirt body 11 has a tensile strength which will withstand the stresses of lifting from several hundred up to one thousand pounds of weight. The type of fiber, the denier, and the weight of the fabric will all affect tensile strength.

Figure 2:
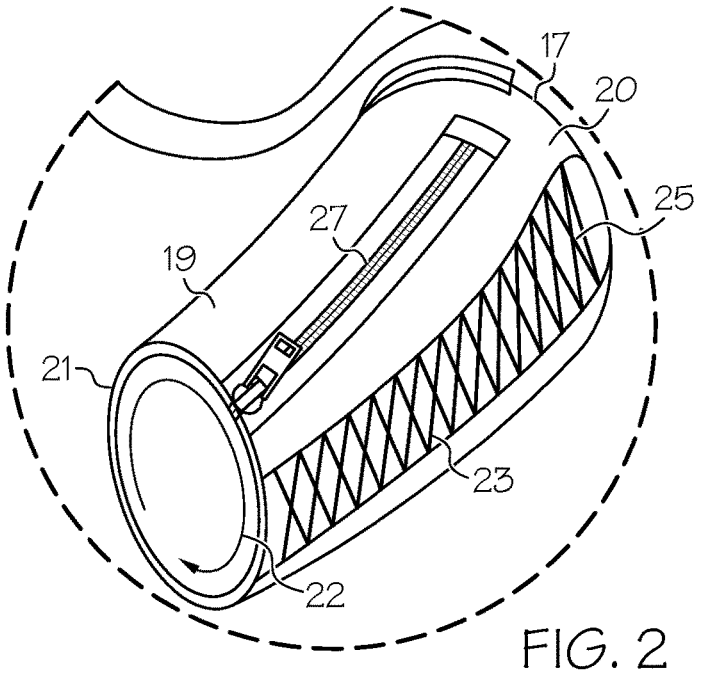
FIG. 2 depicts an enlarged view of a portion of a sleeve of FIG. 1.
Figure 3:
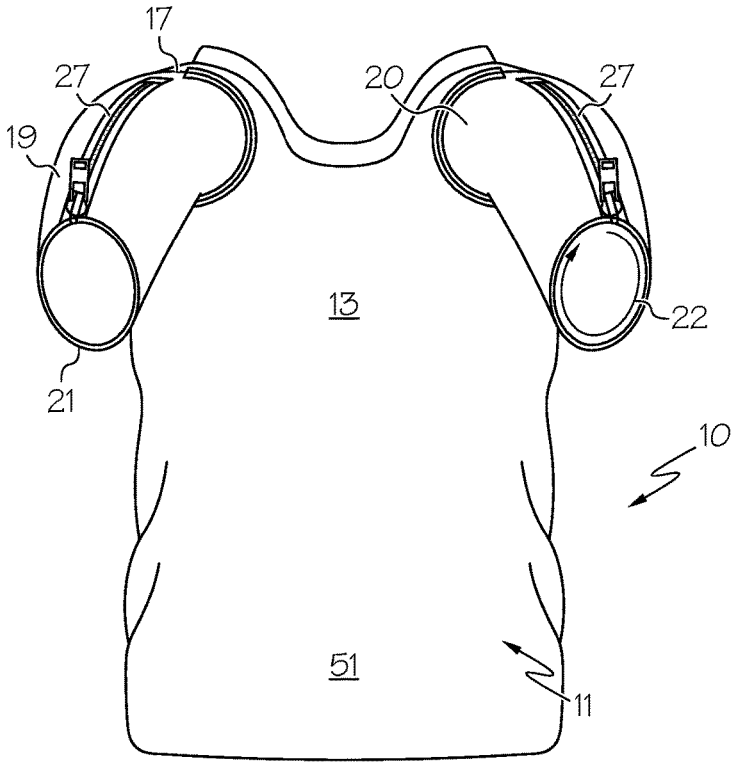
FIG. 3 depicts a front view of the support shirt of FIG. 1.
Figure 4:
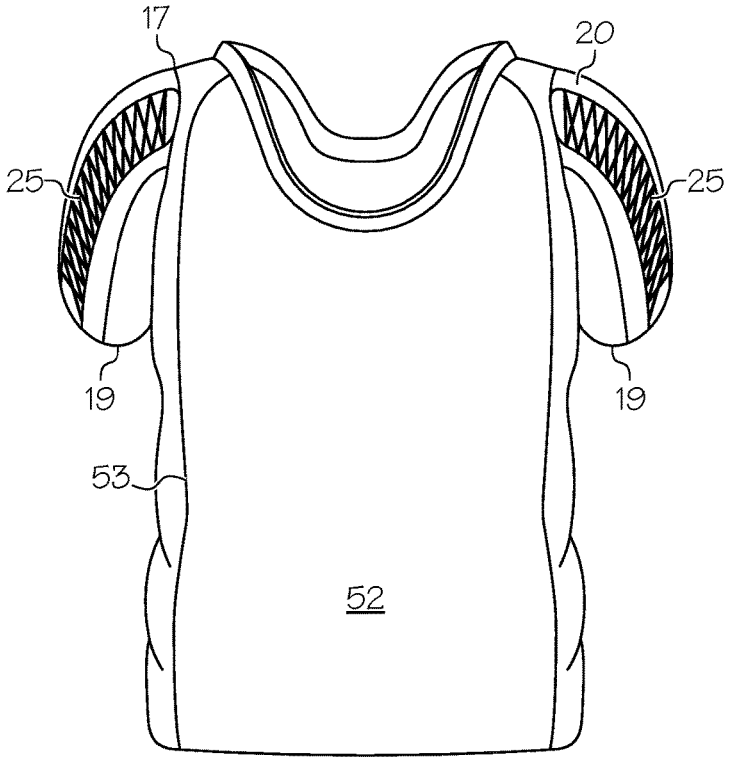
FIG. 4 depicts a back view of the support shirt of FIG. 1.

Sleeves 19 include a first end 20 which is attached to the shirt body 11 at the shirt body sleeve holes 17 and a second end 21, as shown in FIGS. 1 and 2. The sleeves 19 provide compression across the shoulders of the wearer, corresponding with the anterior deltoid, coracobrachialis, scapulae fixer, biceps, and triceps of the wearer. The sleeves 19 are sized such that the fabric is taut when worn, providing support for the shoulders during lifting activities. Thus, the respective circumferences 22 of sleeves 19 are such that they provide a snug fit with the wearer's upper arms.

As shown in FIGS. 1 and 2, each of sleeves 19 includes at least one adjustable member 23. In the embodiment shown, each sleeve includes a first adjustable member comprising laces 25 and a second adjustable member comprising a zipper 27. Each of the laces and zipper extends generally longitudinally along the length of each sleeve, and in the embodiment which is depicted, the respective adjustable members extend substantially along the entire length of each sleeve between first and second ends 20 and 21.

Figure 7A:
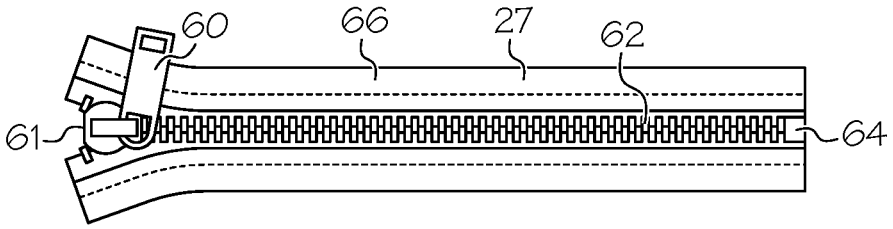
FIG. 7A depicts an enlarged view of the zipper on the sleeves of the support shirt of FIG. 1.
Figure 7B:
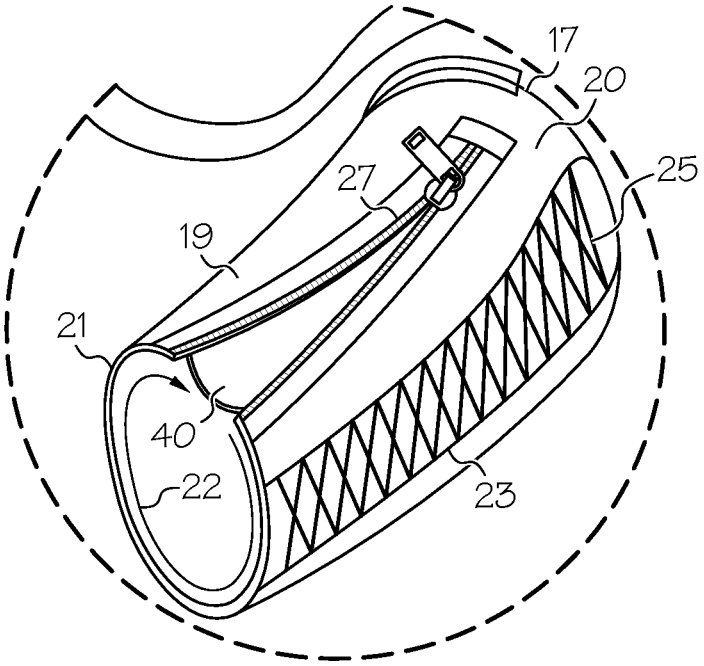
FIG. 7B depicts and enlarged view of a portion of a sleeve of FIG. 1 showing an opened zipper and underlying gusset.
Figure 8:
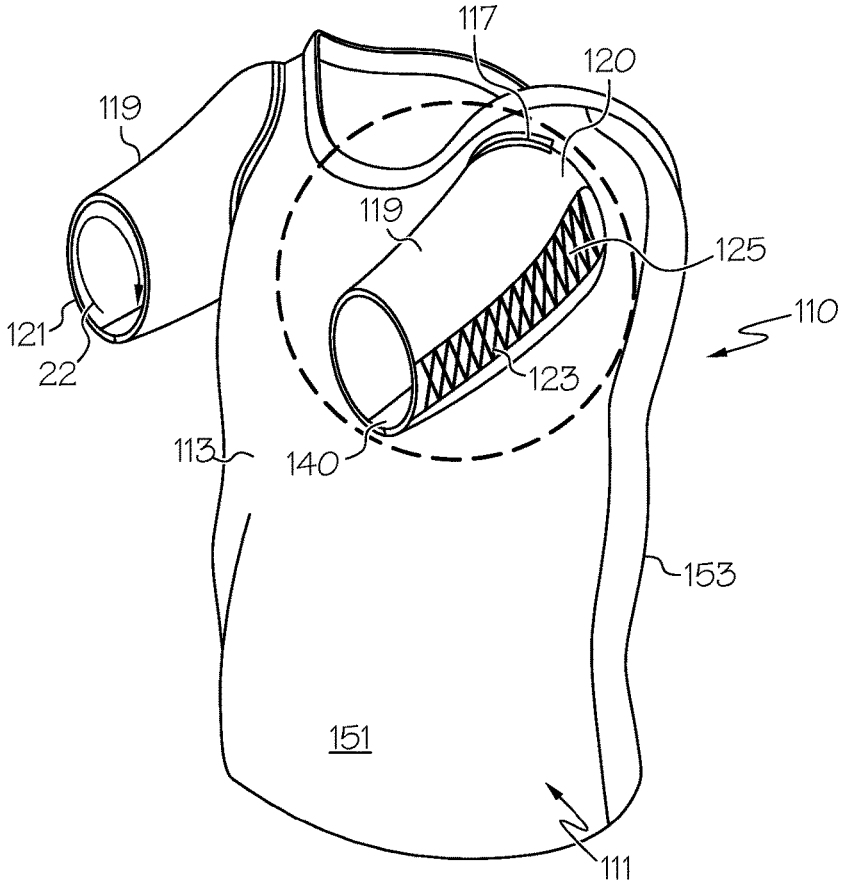
FIG. 8 depicts a perspective view of another embodiment of the adjustable support shirt of the present invention.
Figure 9:
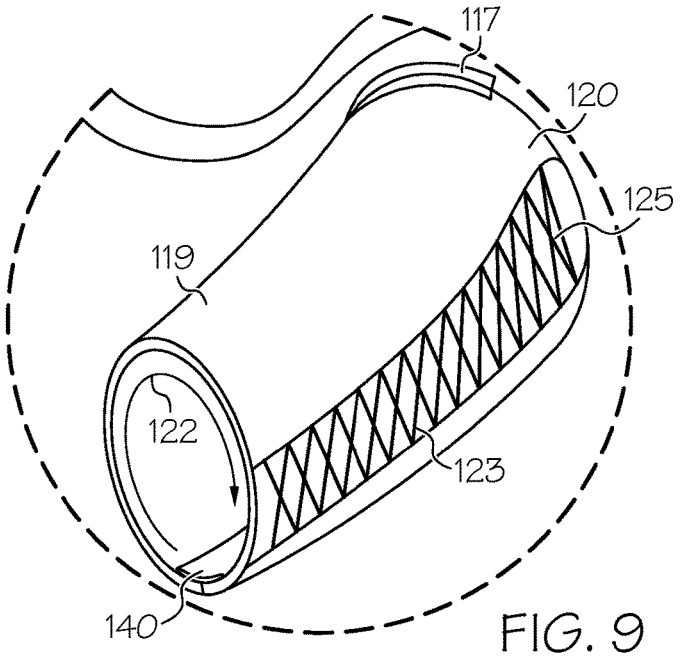
FIG. 9 depicts an enlarged view of a portion of a sleeve of FIG. 8.
Figure 10:
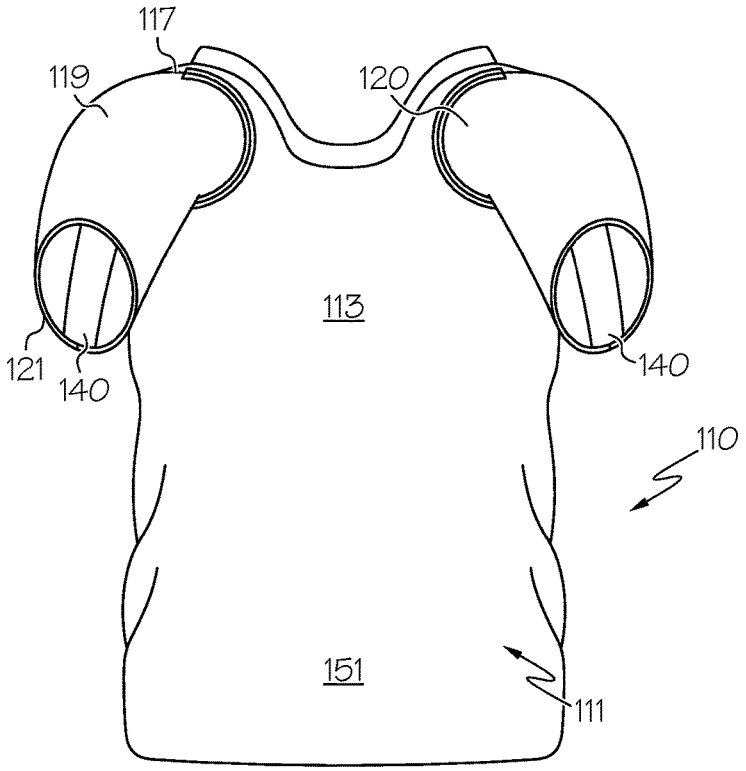
FIG. 10 depicts a front view of the support shirt of FIG. 8.
Figure 11:
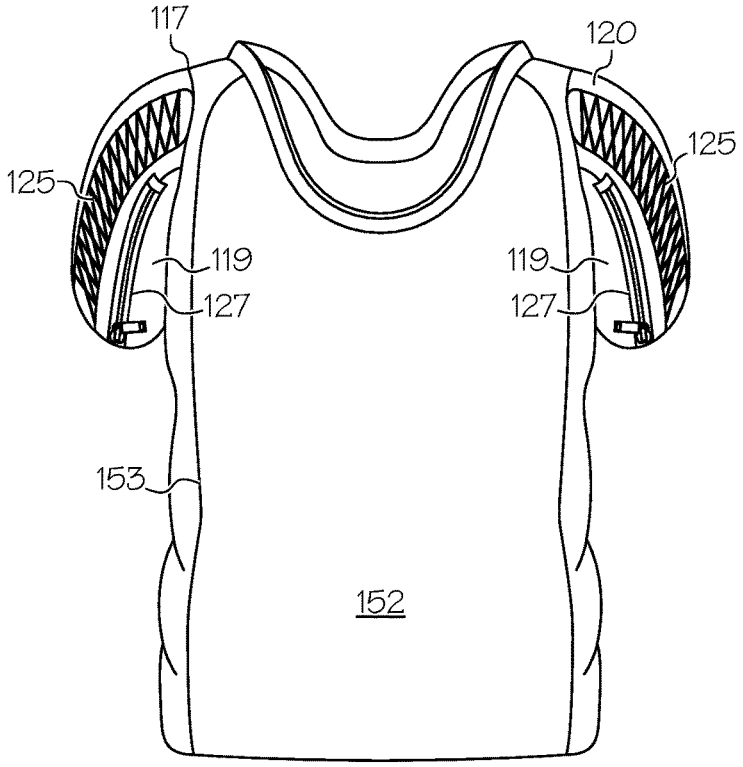
FIG. 11 depicts a back view of the support shirt of FIG. 8.

As can best be seen in FIG. 7B, the various embodiments of the adjustable member are adapted to increase or decrease the circumference 22 of the sleeves 19 which make it easier for the user to put on and take off the shirt. As shown, a gusset 40 made of suitable material such as, for example, an elastic fabric, permits the circumference of the sleeves to be increased when the adjustable member, such as zipper 27 or laces 25 are unzipped or loosened. Gusset 40 controls the amount of increase of the circumference of the sleeves and may be sewn or otherwise bonded to the respective portions of the sleeves.

Figure 20:
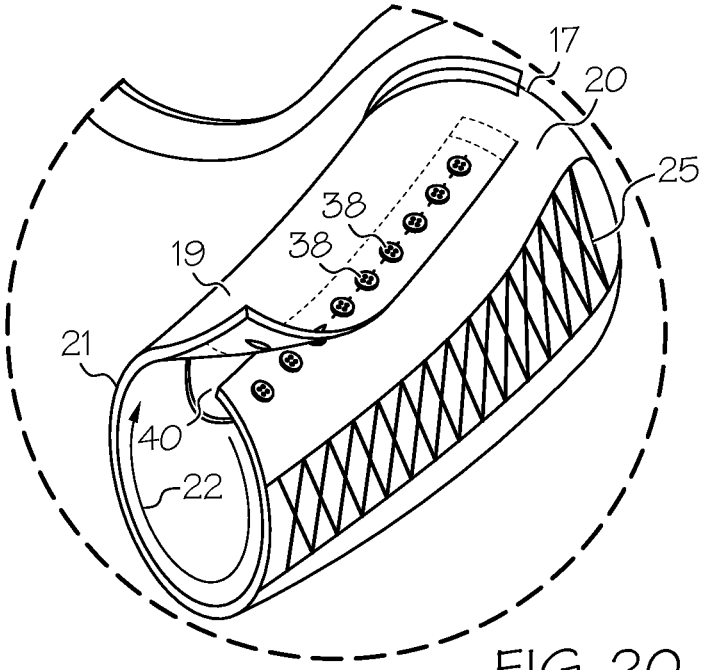
FIG. 20 depicts an enlarged view of a sleeve with an alternative embodiment of the adjustable support shirt.
Figure 21:
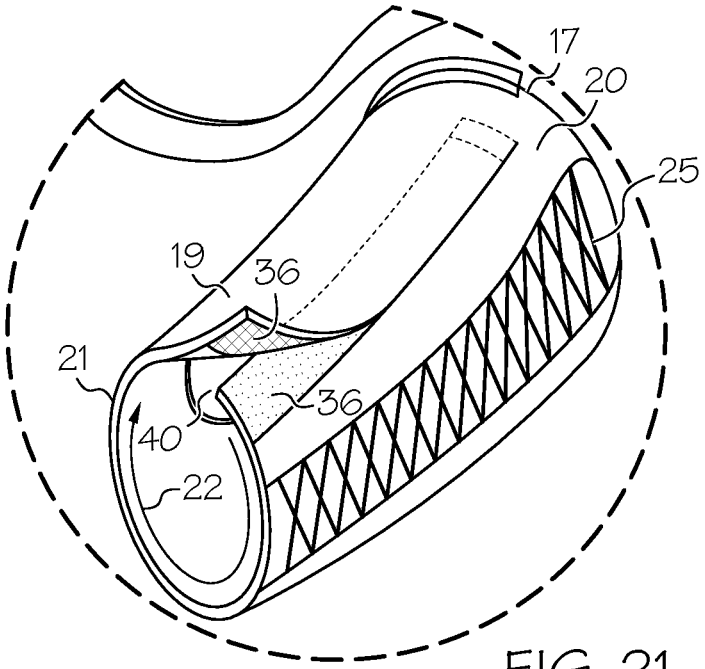
FIG. 21 depicts an enlarged view of another alternative embodiment of the adjustable support shirt.
Figure 22:
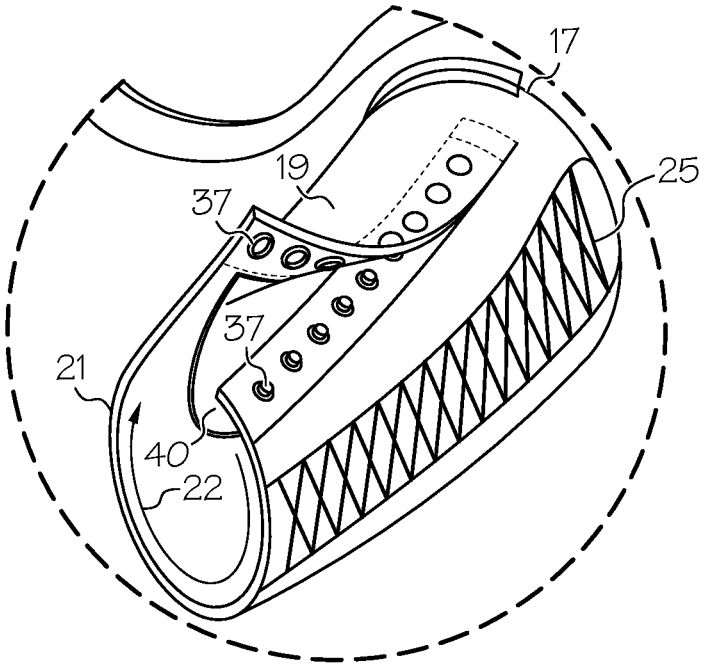
FIG. 22 depicts yet another alternative embodiment of the adjustable support shirt.

In other embodiments, the adjustable member may comprise buttons 38 (see FIG. 20), a hook and loop fastener 36 (see FIG. 21), or snaps 37 (see FIG. 22). The adjustable members 23 make it easier for a user to put on the shirt by increasing the circumference of the sleeves, permitting the wearer to insert his or her arms all of the way into the sleeves. Once the shirt is on and in place, the adjustable member is manipulated (i.e., zipped or laces tightened) to provide a snug and supportive fit for the wearer.

In the embodiment shown in FIGS. 1-7, there are two adjustable members, a zipper 27 and laces 25. Laces 25 extend substantially along the length of sleeve 19 and are oriented on the outward facing side of the sleeves (i.e., the side facing away from the wearer's torso). The laces may comprise any suitable length of material which will withstand the stresses and strains of supporting the arms and shoulders of the wearer. The laces may be made of woven fabric or of a solid length of material, and may include a reinforcing core. For example, there are several grades of paracord (parachute cord) that are commercially available which are suitable for use as laces. Generally, paracord is fabricated from a lightweight, braided material such as nylon, cotton, polyester, or polypropylene fibers which are woven around a core material. Paracord is relatively inelastic.

Alternatively, one can use an elastic cord such as cord material commonly known as Bungee cord. Typically, Bungee cord includes a lightweight, braided exterior layer woven around a core of natural or synthetic rubber. Such elastic cord material will stretch when placed under sufficient strain. When engaging in lifting activities, the laces will stretch and store energy which is then released to aid the lifter. The laces are arranged in a criss-cross fashion, and are looped through either fabric loops or eyelets (not shown) in a known manner.

Zipper 27 also extends substantially along the length of the sleeve and is oriented on the upward facing surface of the sleeve. Both the zipper and laces may be adjusted to loosen (increase the sleeve circumference) or tighten (decrease the sleeve circumference) as needed. As shown in FIG. 7A, zipper 27 includes a pull tab 60, a slider body 61, teeth 62, and a bottom stop 64. As is conventional, the zipper may be sewn or otherwise adhered to the sleeve fabric using tape 66.

Figure 5:
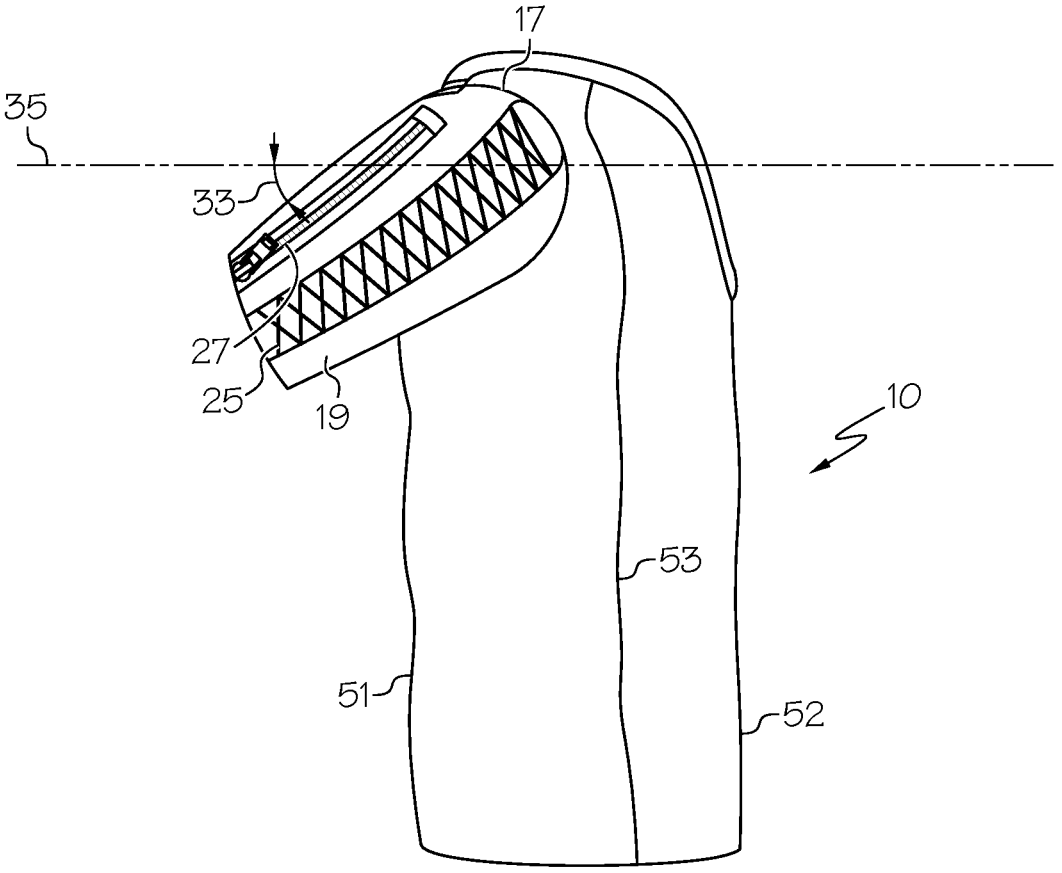
FIG. 5 depicts a side view of the support shirt of FIG. 1.
Figure 6:
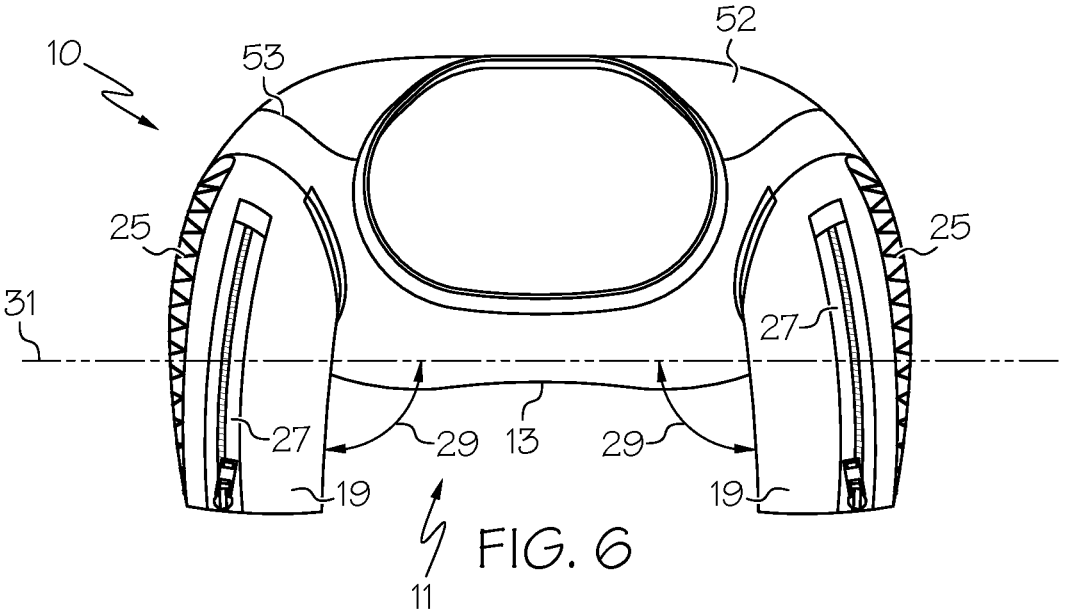
FIG. 6 depicts a top view of the support shirt of FIG. 1.

As shown in FIGS. 5 and 6, in this embodiment, sleeves 19 have a first central angle 29 of approximately 95° relative to the frontal plane 31. However, angle 29 may vary over a broad range depending on the desired use for the shirt. For example, angle 29 may vary between about 60° to about 180°. As shown in FIG. 5, in this embodiment sleeves 19 have a second central angle 33 of approximately 30° relative to the transverse plane 35 of the shirt body 11. However, angle 33 may vary over a broad range depending on the desired use for the shirt. For example, angle 33 may vary between an upwardly-directed angle of about 45° to a downwardly-directed angle of about 45° relative to transverse plane 35.

Referring now to FIGS. 8-13, another embodiment of the adjustable shirt is shown. In this embodiment, there are also two adjustable members, zipper 127 and laces 125. Laces 25 extend substantially along the length of sleeve 19 and are oriented on the outward facing side of the sleeves (i.e., the side facing away from the wearer's torso). The laces may comprise any suitable length of material which will withstand the stresses and strains of supporting the arms and shoulders of the wearer.

Zipper 127 also extends substantially along the length of the sleeve and is oriented on the downward facing surface of the sleeve. Both the zipper and laces may be adjusted to loosen (increase the sleeve circumference) or tighten (decrease the sleeve circumference) as needed.

Figure 12:
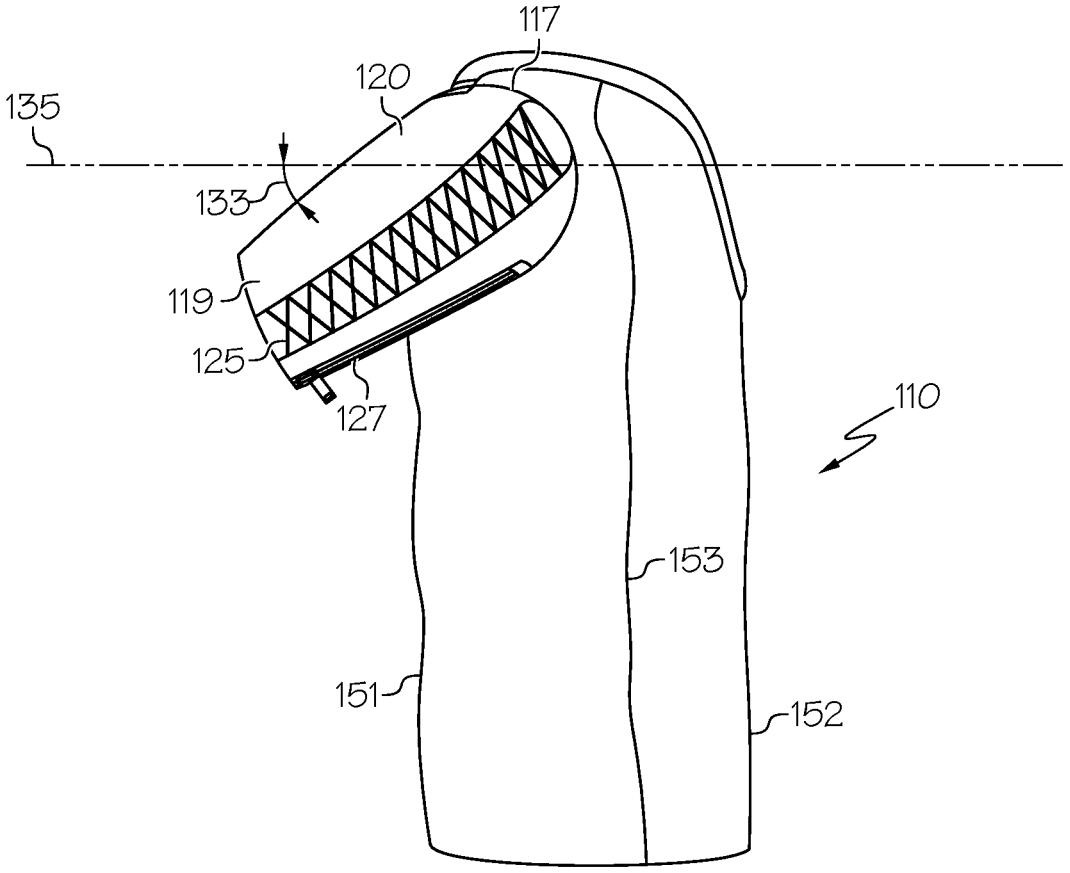
FIG. 12 depicts a side view of the support shirt of FIG. 8.
Figure 13:
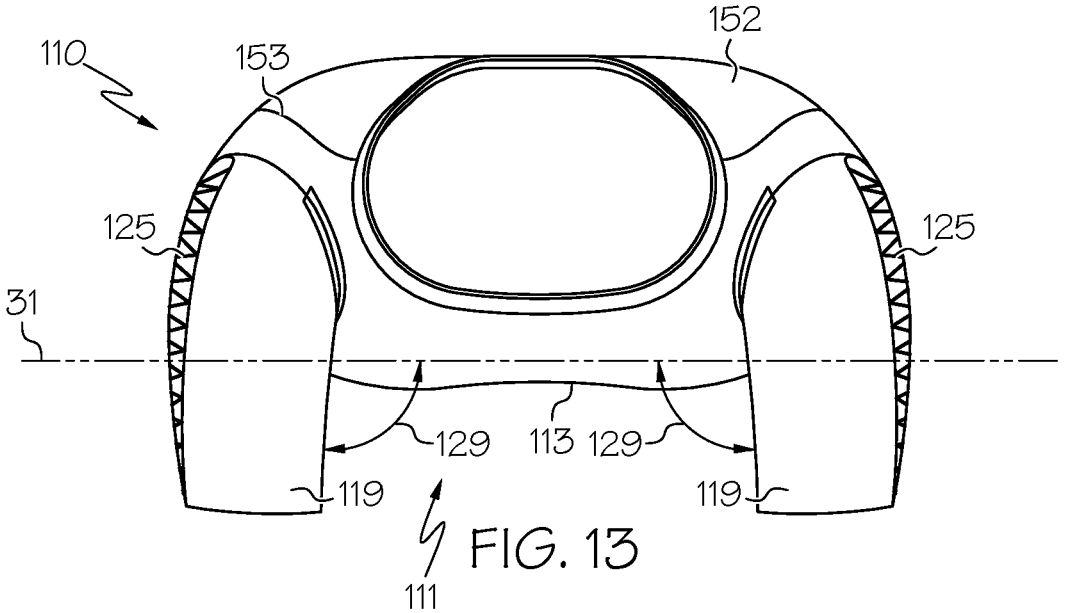
FIG. 13 depicts a top view of the support shirt of FIG. 8.
Figure 14:
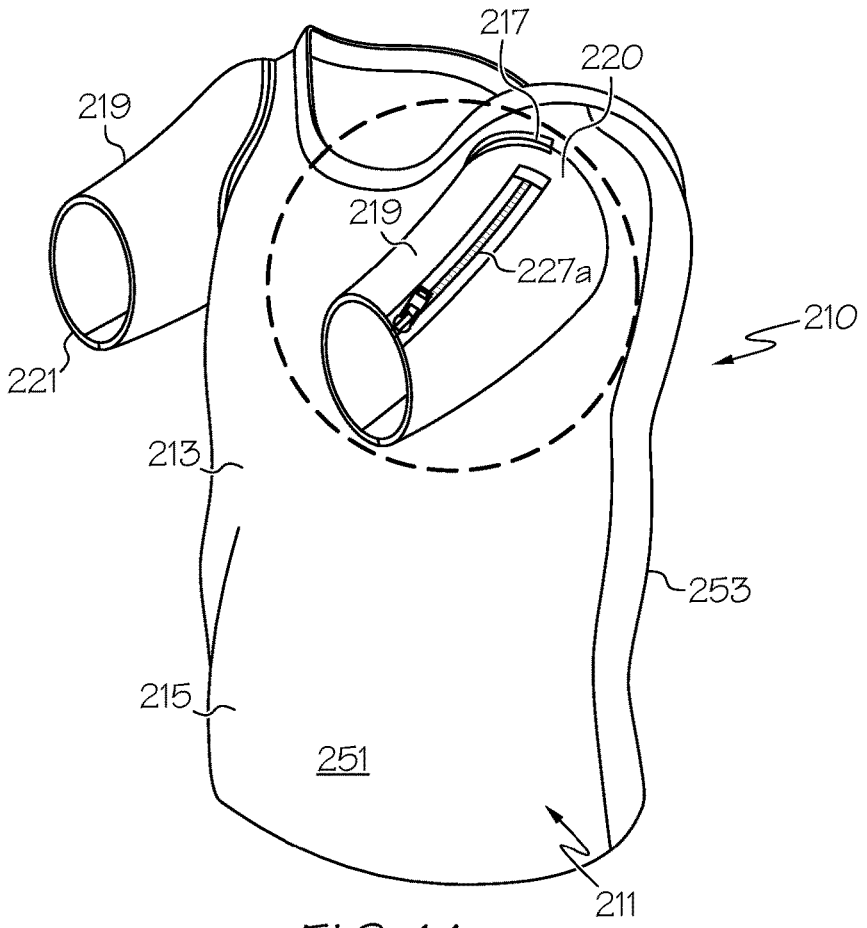
FIG. 14 depicts a perspective view of another embodiment of the adjustable support shirt.
Figure 15:
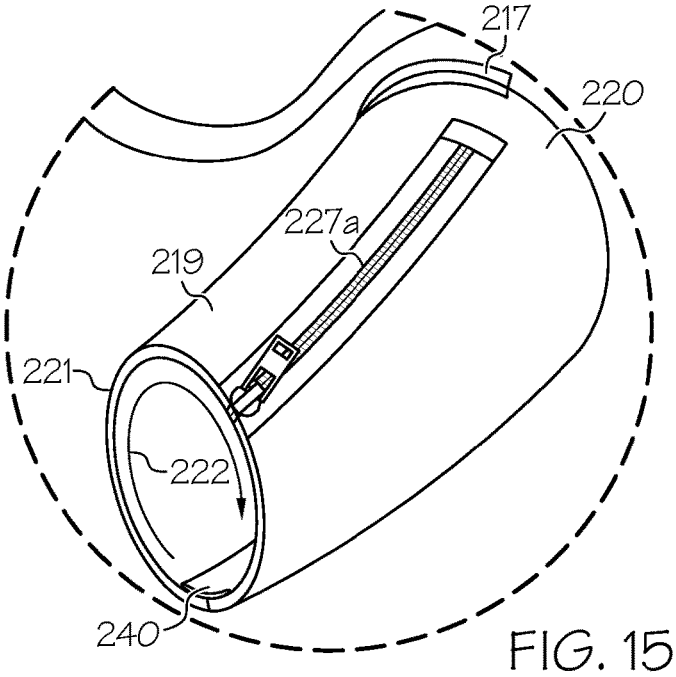
FIG. 15 depicts an enlarged view of the sleeve of FIG. 14.
Figure 16:
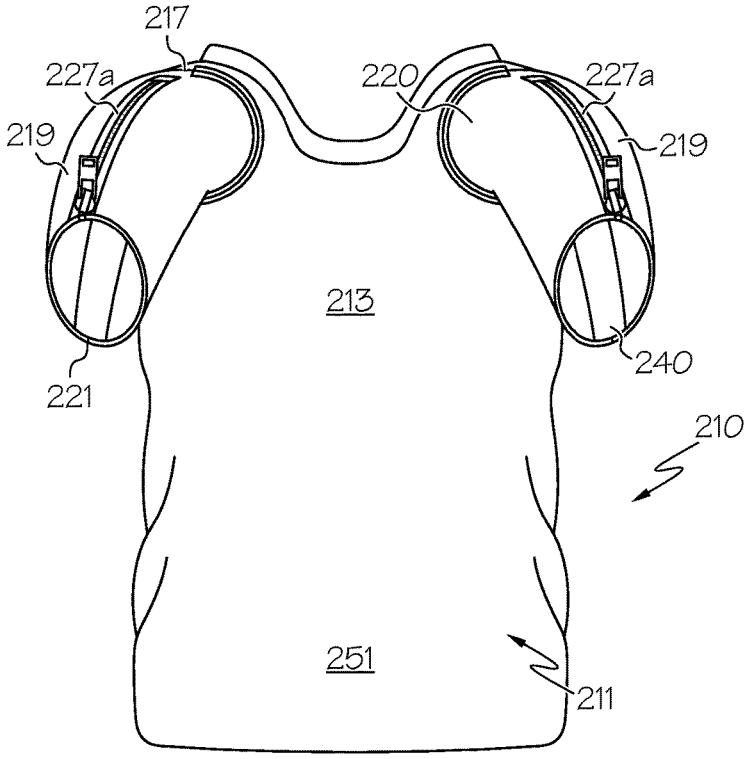
FIG. 16 depicts a front view of the support shirt of FIG. 14.
Figure 17:
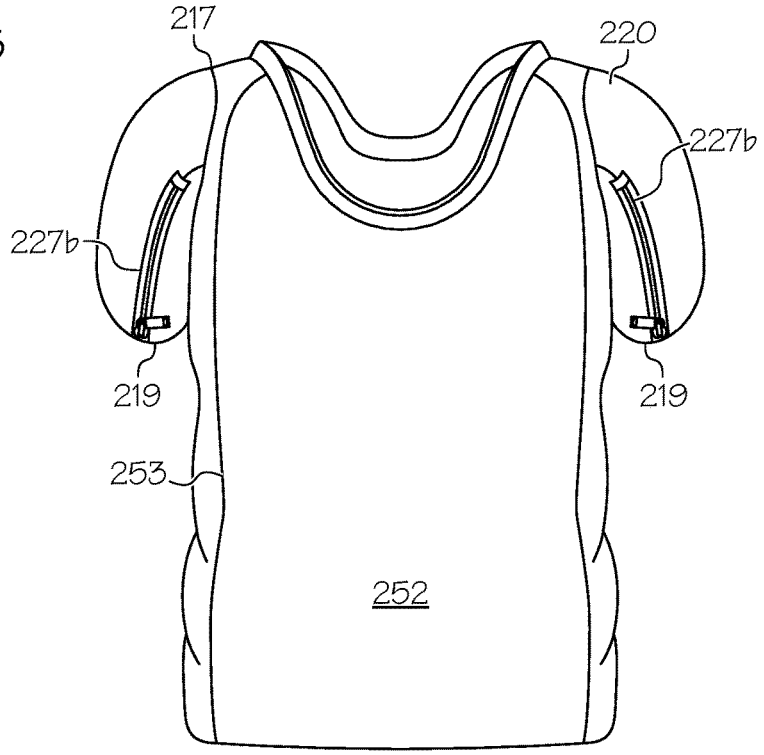
FIG. 17 depicts a back view of the support shirt of FIG. 14.

As shown in FIGS. 12 and 13, in this embodiment, sleeves 119 have a first central angle 129 of approximately 95° relative to the frontal plane 131. However, angle 129 may vary over a broad range depending on the desired use for the shirt. For example, angle 129 may vary between about 60° to about 180°. As shown in FIG. 12, in this embodiment sleeves 119 have a second central angle 133 of approximately 30° relative to the transverse plane 135 of the shirt body 111. However, angle 133 may vary over a broad range depending on the desired use for the shirt. For example, angle 133 may vary between an upwardly-directed angle of about 45° to a downwardly-directed angle of about 45° relative to transverse plane 135.

Referring now to FIGS. 14-19, another embodiment of the adjustable shirt is shown. In this embodiment, there are also two adjustable members, zipper 227*a* and zipper 227*b*. Zippers 227*b* extend substantially along the length of sleeve 219 and are oriented on the upward and downward facing side of the sleeves. Both of the zippers may be adjusted to loosen (increase the sleeve circumference) or tighten (decrease the sleeve circumference) as needed.

Figure 18:
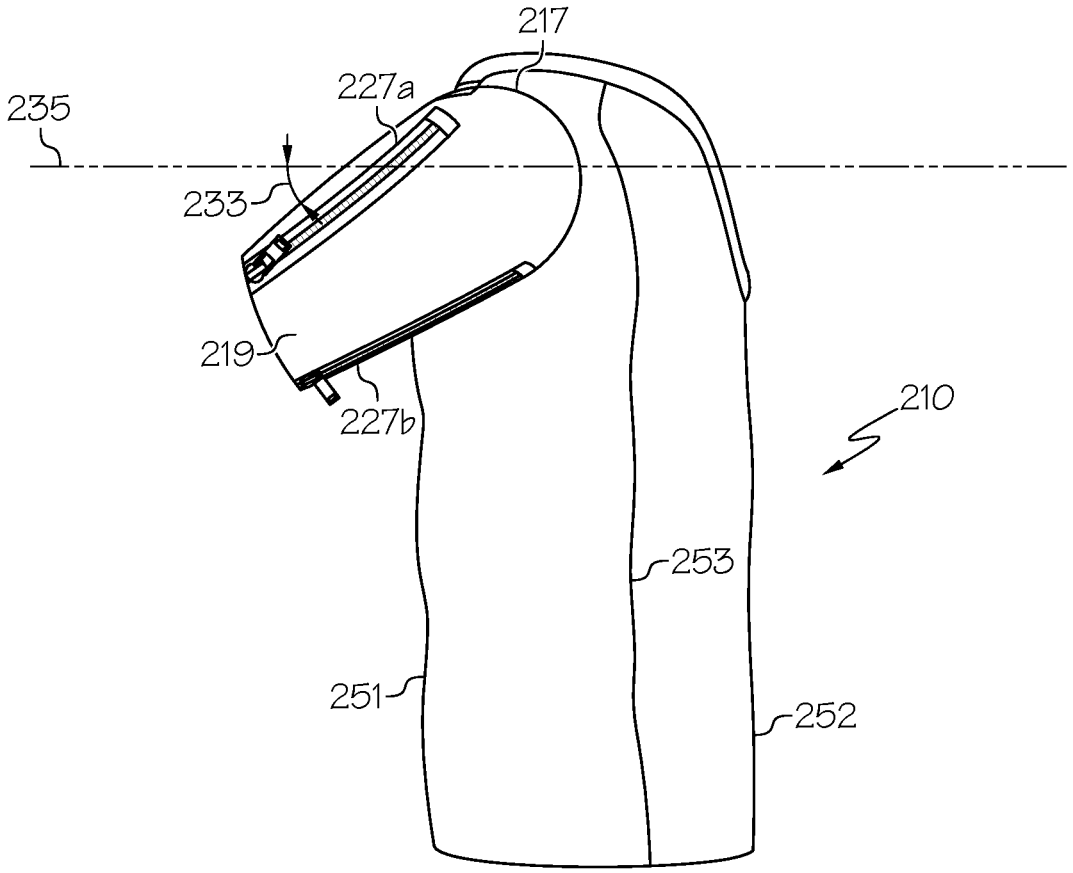
FIG. 18 depicts a side view of the support shirt of FIG. 14.
Figure 19:
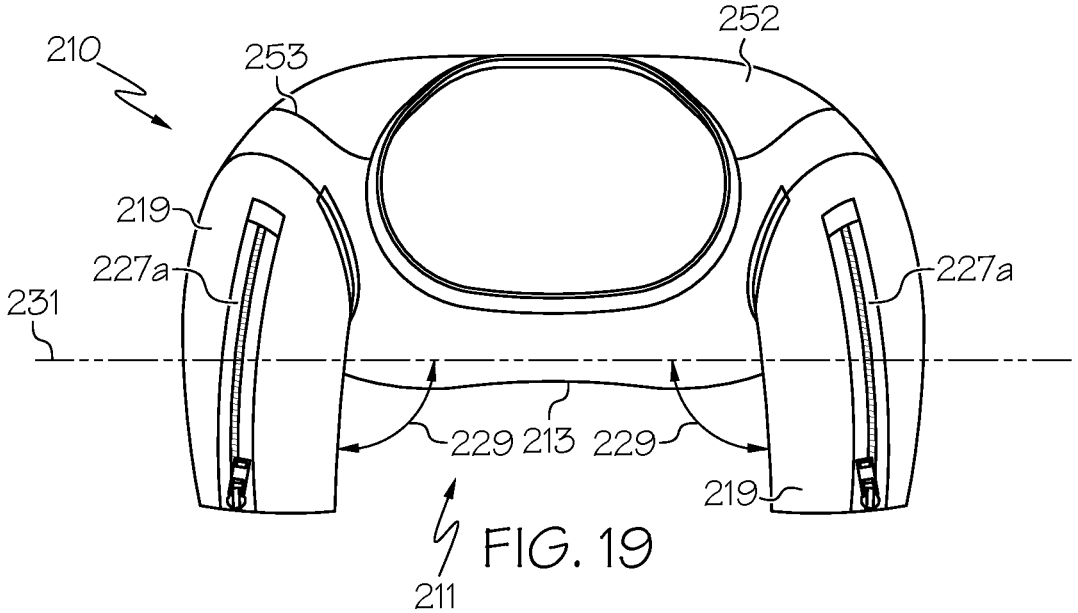
FIG. 19 depicts a top view of the support shirt of FIG. 14.

As shown in FIGS. 18 and 19, in this embodiment, sleeves 219 have a first central angle 229 of approximately 95° relative to the frontal plane 231. However, angle 229 may vary over a broad range depending on the desired use for the shirt. For example, angle 229 may vary between about 60° to about 180°. As shown in FIG. 12, in this embodiment sleeves 219 have a second central angle 233 of approximately 30° relative to the transverse plane 235 of the shirt body 211. However, angle 233 may vary over a broad range depending on the desired use for the shirt. For example, angle 233 may vary between an upwardly-directed angle of about 45° to a downwardly-directed angle of about 45° relative to transverse plane 235.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Unless the meaning is clearly to the contrary, all ranges set forth herein are deemed to be inclusive of all values within the recited range as well as the endpoints.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. An adjustable support shirt comprising:

a shirt body having a shirt front and a shirt back joined together at respective body seams, said shirt front including a pair of sleeve body holes;

a pair of sleeves positioned adjacent to an upper portion of said shirt body, said pair of sleeves comprising respective first ends each attached to said shirt front at said pair of sleeve body holes and second ends each defining a sleeve opening circumference, said pair of sleeves extend forward of a frontal plane extending across said shirt body to provide compression across shoulders of a wearer, the second end of each of said pair of sleeves comprising a free end; and at least one adjustable member provided on each of said pair of sleeves extending generally longitudinally along at least a portion of said pair of sleeves and entirely through said second end of each of said pair of sleeves to said free end of said second end of each of said pair of sleeves, said at least one adjustable member adapted to increase or decrease said sleeve opening circumference.

2. The adjustable support shirt as claimed in claim 1 in which said at least one adjustable member comprises at least one of laces, a zipper, a hook and loop fastener, snaps, and buttons.

3. The adjustable support shirt as claimed in claim 1 in which said at least one adjustable member comprises laces.

4. The adjustable support shirt as claimed in claim 3 in which said laces extend from adjacent the second end of said sleeve to adjacent the first end of said sleeve.

5. The adjustable support shirt as claimed in claim 4 in which said laces are positioned on an outward facing portion of said sleeve away from a wearer's torso.

6. The adjustable support shirt as claimed in claim 1 in which said at least one adjustable member comprises a zipper.

7. The adjustable support shirt as claimed in claim 6 in which said zipper extends from adjacent the second end of said sleeve to adjacent the first end of said sleeve.

8. The adjustable support shirt as claimed in claim 7 in which said zipper is positioned on an upward facing portion of said sleeve.

9. The adjustable support shirt as claimed in claim 1 in which said shirt body comprises a single or multi-ply fabric comprised of cotton, polyester, nylon, or an elastic material.

10. The adjustable support shirt as claimed in claim 1 including first adjustable member and a second adjustable member.

11. The adjustable support shirt as claimed in claim 10 in which said first adjustable member comprises a zipper and said second adjustable member comprises laces.

12. The adjustable support shirt as claimed in claim 10 in which said first adjustable member comprises buttons and said second adjustable member comprises laces.

13. The adjustable support shirt as claimed in claim 10 in which in which said first adjustable member comprises a hook and loop fastener and said second adjustable member comprises laces.

14. The adjustable support shirt as claimed in claim 10 in which in which said first adjustable member comprises snaps and said second adjustable member comprises laces.

15. An adjustable support shirt comprising:

a shirt body comprising a shirt front and a shirt back, said shirt front including a pair of sleeve body holes;

a pair of sleeves positioned adjacent to an upper portion of said shirt body, said pair of sleeves comprising respective first ends each attached to said shirt body at said pair of sleeve body holes and second ends each defining a sleeve opening circumference, the second end of each of said pair of sleeves comprising a free end; and a plurality of adjustable members provided on each of said pair of sleeves, each of said plurality of adjustable members extending generally longitudinally along at least a portion of said pair of sleeves and entirely through said second end of each of said pair of sleeves to said free end of said second end of each of said pair of sleeves, said plurality of adjustable members comprising at least one of laces, a zipper, a hook and loop fastener, snaps, and buttons, said plurality of adjustable members adapted to increase or decrease said sleeve opening circumference.

16. The adjustable support shirt as claimed in claim 15 including a gusset extending beneath and generally coextensive with said at least on adjustable member.

17. The adjustable support shirt as claimed in claim 16 in which said gusset comprises an elastic material.

18. An adjustable support shirt comprising:

a shirt body including a shirt front and a shirt back, said shirt front including a pair of sleeve body holes;

a pair of shirt body sleeves positioned adjacent to an upper portion of said shirt body, said pair of sleeves comprising a first end attached to said shirt body at said pair of sleeve body holes and a second end defining a sleeve opening circumference, the second end of each of said pair of sleeves comprising a free end; and a plurality of adjustable members provided on each of said pair of sleeves, each of said plurality of adjustable members extending generally longitudinally along at least a portion of said pair of sleeves and entirely through said second end of each of said pair of sleeves to said free end of said second end of each of said pair of sleeves, one of said plurality of adjustable members comprising laces and another of said plurality of adjustable members comprising a zipper, said plurality of adjustable members adapted to increase or decrease said sleeve opening circumference.

19. The adjustable support shirt as claimed in claim 18 in which said pair of sleeves extend forward at an angle of from about 60° to about 180°.

20. The adjustable support shirt as claimed in claim 19 in which said pair of sleeves extend from a transverse plane extending substantially perpendicular to said frontal plane at an angle of from about +45° to about −45°.

* * * * *